US010655798B2

(12) United States Patent
Wen et al.

(10) Patent No.: US 10,655,798 B2
(45) Date of Patent: May 19, 2020

(54) LED LIGHTING DEVICE AND METHOD FOR MANUFACTURING THE SAME

(71) Applicant: LEDVANCE GmbH, Garching bei Munchen (DE)

(72) Inventors: Haitao Wen, Guangdong (CN); Jun Liu, Guangdong (CN); Xiongqiang He, Guangdong (CN); Shijun Nie, Guangdong (CN)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 16/072,023

(22) PCT Filed: Jan. 20, 2017

(86) PCT No.: PCT/EP2017/051182
§ 371 (c)(1),
(2) Date: Jul. 23, 2018

(87) PCT Pub. No.: WO2017/125545
PCT Pub. Date: Jul. 27, 2017

(65) Prior Publication Data

US 2019/0032863 A1 Jan. 31, 2019

(30) Foreign Application Priority Data

Jan. 22, 2016 (CN) ..... 2016 1 0041814

(51) Int. Cl.

| | |
|---|---|
| ***F21K 9/278*** | (2016.01) |
| ***F21K 9/90*** | (2016.01) |
| ***F21V 23/00*** | (2015.01) |
| *F21Y 103/10* | (2016.01) |
| *F21Y 115/10* | (2016.01) |

(52) U.S. Cl.
CPC ..... *F21K 9/278* (2016.08); *F21K 9/90* (2013.01); *F21V 23/005* (2013.01); *F21Y 2103/10* (2016.08); *F21Y 2115/10* (2016.08)

(58) Field of Classification Search
CPC . F21K 9/278; F21K 9/275; F21K 9/90; F21V 23/005
See application file for complete search history.

(56) References Cited

U.S. PATENT DOCUMENTS

2010/0008085 A1* 1/2010 Ivey ..... F21K 9/27 362/218
2012/0262921 A1 10/2012 Boomgaarden et al.
(Continued)

FOREIGN PATENT DOCUMENTS

| | | | |
|---|---|---|---|
| DE | 202010013037 | U1 | 3/2011 |
| DE | 102014205360 | A1 | 9/2015 |
| WO | 2015179731 | A1 | 11/2015 |

*Primary Examiner* — Anh T Mai
*Assistant Examiner* — Nathaniel J Lee
(74) *Attorney, Agent, or Firm* — Hayes Soloway PC

(57) ABSTRACT

An LED lighting device includes a housing, an LED light-emitting unit arranged inside the housing, and an LED driver configured to drive the LED light-emitting unit to operate. The LED driver and the LED light-emitting unit are integrally arranged inside the housing. The LED lighting device allows the number of components to be reduced, and the structure to be more compact, thus allowing the LED driver to be set inside a housing of a small lighting device.

21 Claims, 6 Drawing Sheets

(56) References Cited

U.S. PATENT DOCUMENTS

| | | | | |
|---|---|---|---|---|
| 2013/0170196 | A1* | 7/2013 | Huang | F21V 3/061<br>362/221 |
| 2015/0267874 | A1 | 9/2015 | Terazawa | |
| 2017/0051881 | A1* | 2/2017 | Chamberlain | F21K 9/275 |

* cited by examiner

LED LIGHTING DEVICE AND METHOD FOR MANUFACTURING THE SAME

CROSS-REFERENCE TO RELATED APPLICATIONS

This application is a U.S. National phase entry under 35 U.S.C. § 371 of International Application No. PCT/EP2017/051182, filed on Jan. 20, 2017, which claims priority to Chinese Patent Application 201610041814.9, filed on Jan. 22, 2016. Each of these patent applications is incorporated by reference herein in its entirety.

FIELD

This application relates to an LED (light-emitting diode) lighting device, and particularly to an LED lighting device which has a compact structure and is convenient to install, and a method for manufacturing the LED lighting device.

BACKGROUND

As is well known, LED lighting has many irreplaceable advantages, so LED is more and more used as a light source of a lighting device for replacing a conventional light source. An LED tube is a main product employed in an indoor LED lighting device. Compared with a conventional daylight tube and a fluorescent tube, the LED tube has a higher lumen efficiency and a longer service life, and is more energy-saving and environment-friendly. Furthermore, an LED tube does not require a ballast or a starter, and is easy to implement modular manufacture and installation. So LED tube has been increasingly popular and has been employed in various aspects of production and life.

For an LED lighting device, an external power supply is generally applied to the LED light-emitting unit via an LED driver as an LED constant-current driving source to allow LED to emit light. Conventionally, the LED driver is constituted by a drive circuit including multiple electronic components, and is electrically connected as an integral piece in a form of a separate package or a circuit board to the LED circuit board of the LED light-emitting unit in the housing. Hence the number of the components is large, and further the procedures for manufacturing and assembling the components are complicated, such that the space in the lighting device cannot be utilized effectively.

SUMMARY

One object of the present invention is to provide a new type LED lighting device having reduced number of components, and a more compact structure.

Another object of the present invention is to provide a new type LED lighting device with a high bending strength.

Another object of the present invention is to provide an LED lighting device easy to implement modular production, easy to assemble.

Still another object of the present invention is to provide an LED lighting device having a low cost and easy to manufacture, which can effectively address the issue caused by mismatching of thermal expansion coefficients of different materials.

One or more of the above objects may be achieved by an LED lighting device according to the present invention. The LED lighting device includes: a housing; an LED light-emitting unit arranged inside the housing; and an LED driver, configured to drive the LED light-emitting unit to operate; wherein the LED driver and the LED light-emitting unit are integrally arranged inside the housing.

By integrating the LED driver and the LED light-emitting unit into one piece, the objects of reducing the number of components, simplifying the structure and the assembling steps and saving the space are achieved.

Preferably, the LED lighting device further includes a bracket made of steel, configured to support the LED driver and the LED light-emitting unit inside the housing, and also used to dissipate heat and improve a bending strength of the lighting device.

Preferably, the light device further includes an end cap configured to close an opening of the housing, and configured to electrically connect the LED driver and the LED light-emitting unit to an external power supply. More preferably, the end cap includes a locking part, and the end cap may be snap-fitted to the bracket by the locking part. Thus, simple assembling is achieved, and the issue of getting stuck or deformation of the plastic tube caused by mismatching of thermal expansion coefficients of different materials is addressed.

A method for manufacturing a lighting device is further provided according to the present invention, which includes the following steps: soldering electronic components of an LED driver and LED elements of an LED light-emitting unit on the same circuit board; adhesively bonding the soldered circuit board on a bracket; disposing the adhesively bonded assembly of the circuit board and the bracket into a housing from an opening of the housing; and closing the opening of the housing by an end cap.

BRIEF DESCRIPTION OF THE DRAWINGS

Features and advantages of the present invention may be understood more readily from the detailed description to specific embodiments given by reference to the drawings in which, like features or components are indicated by like reference numerals, and the drawings are not necessarily drawn to scale, and in which.

DETAILED DESCRIPTION

Exemplary embodiments of the present invention will be described hereinafter in detail with reference to the drawings. The description of the exemplary embodiment is only for the purposes of example, and not a limitation to the present invention and the application or use thereof.

Spatially relative terms, such as "inner", "outer", "beneath", "below", "low", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the features is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

An LED lighting device according to the present invention will be described hereinafter with reference to FIGS. 1 and 2 by taking an LED tube as an example.

Figure 1:
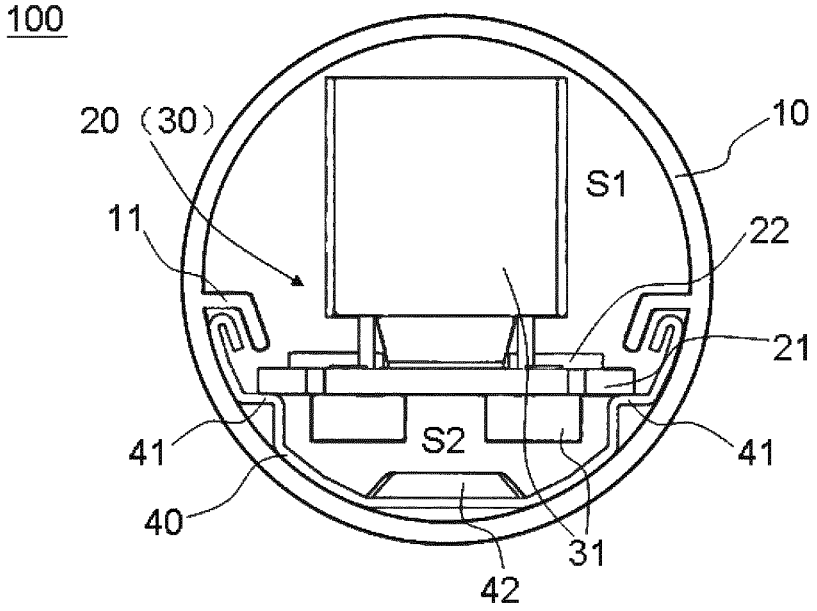
FIG. 1 is a schematic cross sectional view showing an LED lighting device according to an embodiment of the present invention.

As shown in FIG. 1, an LED lighting device (LED tube) 100 according to an embodiment of the present invention includes a housing 10 and an LED light-emitting unit 20 arranged inside the housing 10.

The housing 10 is typically a lamp tube of various models, such as extruded T5, T8 tubes. Since the heat generated by an LED light source is low, instead of metals and glass materials with high heat resistance, the housing 10 according to the embodiment of the present invention for example may be a T5 plastic tube, the T5 plastic tube is extruded from a polymer material which has high light transmission, strong water resistance, is not easy broken, is easy molded, and is of aging resistance, light weight and low cost. The polymer material may be for example polycarbonate (PC), polymethyl methacrylate (PMMA), polyvinyl chloride (PVC) etc. However, the housing of the lighting device of the present invention is not limited thereto, and may be formed from any suitable materials.

Figure 2:
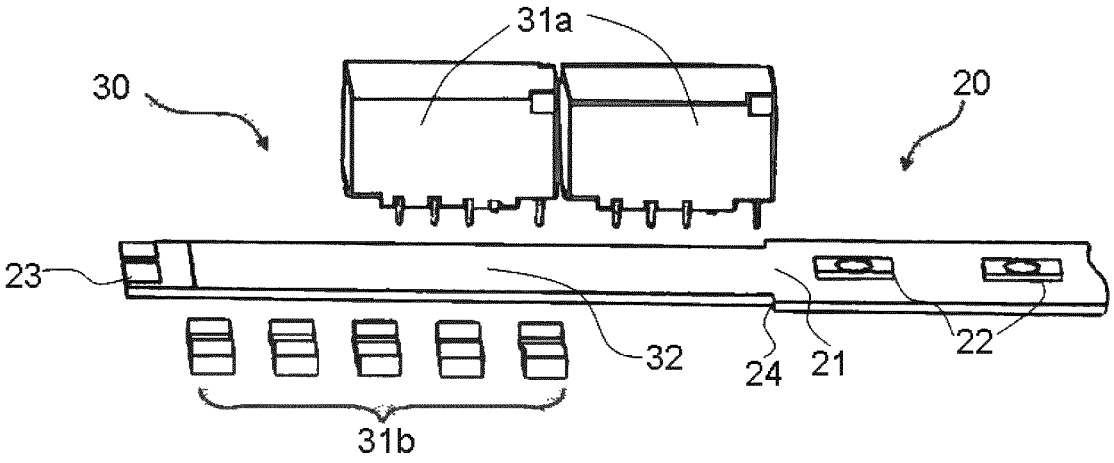
FIG. 2 is a schematic exploded perspective view of an LED driver integrated on an LED circuit board in the LED lighting device according to an embodiment of the present invention.

As shown in FIG. 2, the LED light-emitting unit 20 consists of an LED circuit board (PCB) 21 and at least one LED element 22 mounted on the LED circuit board 21. The LED elements 22 may be arranged in a row as shown, and may also be arranged in multiple rows, or in any patterns as desired.

The LED element is a solid-state semiconductor light source capable of converting an electrical energy into a visible light, with the specific voltage current characteristic of the semiconductor light source, when the voltage applied on the LED element exceeds the dead zone voltage, the current changes exponentially with the voltage. Therefore, in order to allow the LED element to work normally and not to be burned out due to a slight fluctuation of the voltage, the LED lighting device 100 generally further includes an LED driver 30, which is used as a constant-current driving source for the LED element 22 to control the current flowing through the LED element, such that the current will not be higher than the rated current of the LED element and will not be affected by a difference in a forward bias voltage and in an input voltage of the LED element. The LED driver 30 is namely a component by which commercial electricity is transformed, rectified and filtered to be outputted to the LED light-emitting unit 20, and the LED driver 30 generally consists of a drive circuit 32 including multiple electronic components 31.

In the conventional technology, the LED driver is, generally electrically connected as an integral component in a form of a separate package or a circuit board to the LED circuit board of the LED light-emitting unit accommodated in the housing of the lighting device, thus an electrical connecting device is required to be provided additionally, which increases the complexity and cost of processing and assembly. Especially, in the case that the interior space of the housing of the LED lighting device is insufficient, the LED driver will be arranged outside the lighting device, for example, on a special mounting bracket or a lamp socket, and is electrically connected to the interior of the lighting device via an electric wire. Take LED tube for example, it may be classified, according its diameter and from small to large, into T2, T3, T4, T5, T8, T10 and T12 tubes, among which, T5 tube and T8 tube are most common. T8 tube has a diameter of 26 mm and thus has an interior space large enough to have an conventional LED drive directly accommodated in the tube and electrically connected to the LED circuit board. By contrast, T5 tube only has a diameter of 16 mm with limited interior space. Therefore, a T5 tube in the conventional technology often adopts an external LED driver due to its insufficient interior space, and a special mounting bracket is also provided to be used with the T5 tube, thus the manufacturing cost of the product is higher, the installation on site is more complex, and the aesthetics and safety and practicability of the product are reduced.

As shown in FIG. 2, in the lighting device 100 according to the embodiment of the present invention, the drive circuit 32 of the LED driver 30 is integrated on the LED circuit board 21, and the multiple electronic components 31 of the LED driver 30 are soldered in the drive circuit 32, thereby the LED driver 30 integrated with the LED light-emitting unit 20 is formed.

Specifically, as shown in FIG. 2, a circuit board plug 23, which is configured to be electrically connected to an external power supply (not shown), is provided at a tip end of the LED circuit board 21. The LED driver 30 is integrated on a section of the LED circuit board 21 between the circuit board plug 23 and the LED array. The external power supply is applied to the LED driver 30 via the circuit board plug 23. After being processed by the LED driver 30, a constant current that meets the operational requirement of the LED element 22 is outputted from the LED driver 30.

Compared with the conventional technology in which the LED driver 30 is electrically connected as a separate component to the LED circuit board 21, integration of the LED driver 30 on the LED circuit board 21 is able to reduce the number of the separate components in the lighting device, and reduce the need for additional electrical connection between the LED driver and the LED circuit board, thus simplifying the structure and assembly of the lighting device, and reducing the number of fault points to improve the reliability of operation. Further, since the structure and assembly of the lighting device is simplified, space saving can be achieved, this is especially important for a small lighting device.

Furthermore, as shown in FIGS. 1 and 2, the multiple electronic components 31 of the LED driver 30 are divided into a first set of one or more electronic components 31*a* having similar height dimensions and a second set of one or more electronic components 31*b* having similar height dimensions based on the height in a direction perpendicular to the LED circuit board 21 under the installation condition. The first set of electronic components 31*a* each is higher than each of the second set of electronic components 31*b* in height. For example, the height of each electronic component in the first set of electronic components 31*a* may be in the range of ⅕ to ⅗ of the diameter of the housing, and the height of each electronic component in the second set of electronic components 31*b* may be smaller than ⅕ of the diameter of the housing. The range of value may be adjusted according to the distribution of height and other dimension (for example, the footprint on the LED circuit board) of these electronic components. The first set of electronic components 31*a* may include for example a relay or the like, and the second set of electronic components 31*b* may include for example a resistor, a capacitor or the like. The first set of electronic components 31*a* and the second set of electronic components 31*b* may be respectively soldered on opposite side surfaces of the LED circuit board 21. According to an embodiment of the present invention, the LED element 22 and the first set of electronic components 31*a* are arranged on an upper side surface of the LED circuit board 21, and the second set of electronic components 31*b* are arranged on a lower side surface of the LED circuit board 21.

Since the electronic components 31 of the LED driver 30 are divided to be arranged on the upper and lower side surfaces of the LED circuit board 21, compared with the case that these electronic components are arranged on one side of the LED circuit board, the interior space of the tube may further be effectively used, which makes it possible for a small lighting device such as T5, T4 tubes to allow the LED driver to be internally mounted, thus eliminating the need for a special mounting bracket.

In addition, as shown in FIG. 1, the LED lighting device 100 of the present invention may further include a bracket 40 configured to support the LED circuit board 21. The bracket 40 is arranged at an inner surface of the housing 10 and is made of steel. The bracket 40 extends at least in a length of the LED circuit board 21 provided with the LED elements 22. Since the bracket 40 contacts directly with the LED light-emitting unit 20 and is made of steel with good heat dissipation, the bracket 40 may be used as a heat sink for the LED light-emitting unit 20. Further, since steel has a higher bending strength than common materials for the heat sink such as metallic aluminum, the steel bracket 40 of the present invention also addresses the issue of low bending strength of the plastic housing 10.

The cross section of the bracket 40 generally has an arc shape, is in conformity with a profile of the inner surface of the housing 10 and is configured to fit against the inner surface of the housing 10. According to some embodiments of the present invention, two side ends of the arc-shaped bracket 40 respectively abut two hook-shaped portions 11 which are formed integrally on the inner surface of the housing 10 to extend in a direction towards the bracket 40, to limit the slippage of the bracket 40 in a circumferential direction along the inner surface of the housing 10. The hook-shaped portions 11 may be extruded integrally with the housing 10. As shown in FIG. 1, edges of the two side ends of the arc-shaped bracket 40 may be folded to prevent it from bending and deforming. Alternatively, in the case that the bracket 40 is made of an elastic steel sheet, the bracket 40 may be held on the inner surface of the housing 10 by way of its own elastic expansion force.

As shown in FIG. 1, the bracket 40 may include a supporting part 41. The LED circuit board 21 may be arranged on the supporting part 41 of the bracket 40 to separate the interior of the housing 10 into two spaces S1 and S2. The first set of electronic components 31*a* and the second set of electronic components 31*b* may be accommodated in the spaces S1 and S2 respectively.

In the embodiment shown in FIG. 1, the opposing sides of the bracket 40 are symmetrically formed with bent sections recessed towards the inner side. The bent section is formed by bending a portion of the bracket and includes a horizontal portion and a vertical portion. The horizontal portions of the bent sections at the opposite sides form the supporting part 41 capable of supporting the LED circuit board 21. Two sides of the LED circuit board 21 are rested on the supporting part 41 to separate the interior of the housing 10 into the first space S1 at an upper side and the second space S2 at a lower side. The position of the supporting part 41 in the height direction may be properly set based on the spaces required by the first set of electronic components 31*a* and the second set of electronic components 31*b*.

Figure 3:
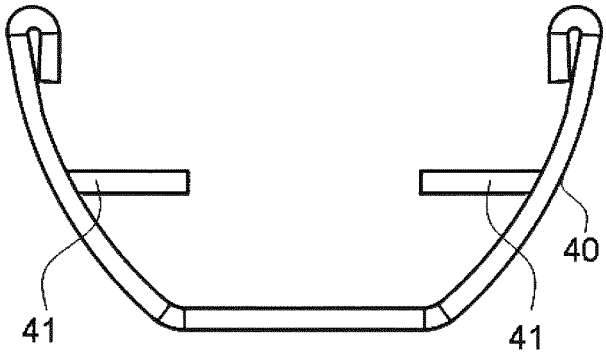
FIG. 3 is a schematic cross sectional view of a bracket according to another embodiment of the present invention.

The shape of the bracket 40, the way of fixing the bracket 40 and the configuration of the supporting part 41 are not limited to the specific example described above, and may be implemented in different ways, and the implementations all fall into the scope of the present invention. FIG. 3 shows a possible variation of the bracket 40 in FIG. 1, in which a pair of arms extend close to each other inwardly from opposite sides of a body of the bracket 40, forming the supporting part 41 configured to support the LED circuit board 21.

Figure 4:
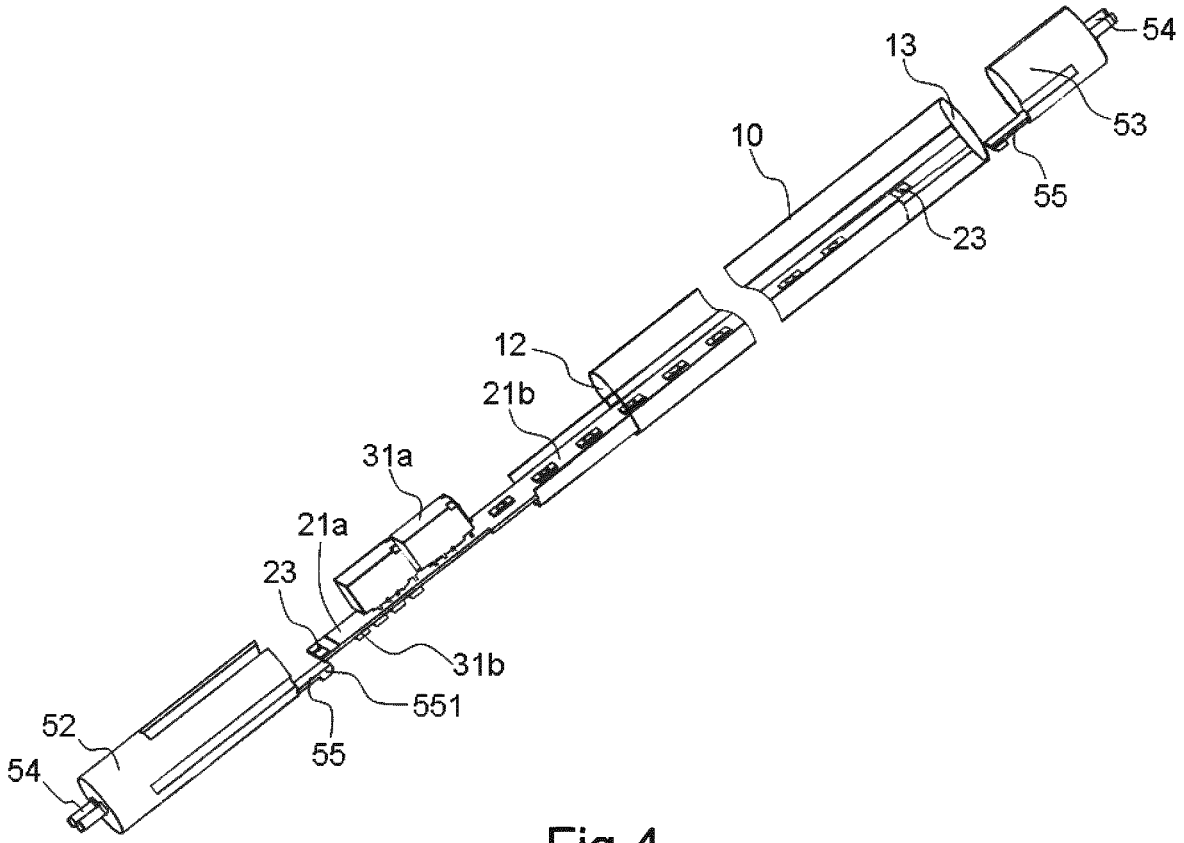
FIG. 4 is a schematic exploded perspective view of the LED lighting device according to an embodiment of the present invention.

Reference is made to FIG. 4, which shows a schematic exploded view of the LED lighting device 100 according to the embodiment. As shown, the LED lighting device 100 further includes end caps 52 and 53 provided at two ends of the housing 10. The housing 10 may be closed by inserting the end caps 52 and 53 respectively into openings 12 and 13 at opposite sides of the housing 10, the end caps 52 and 53 may form an interference fit with the housing 10. The LED circuit board 21 has an elongated shape and may extend along the whole length of the housing 10. The LED circuit board 21 includes a first section 21*a* integrated with the LED driver 30 and a second section 21*b* provided with the LED element array. The first section 21*a* is located near an opening of the housing 10, such that the LED driver 30 may be electrically connected to an external power supply via the end cap.

As shown in FIG. 4, each of the end caps 52 and 53 has a cylindrical shape with one end closed, and is made of a material that is opaque. For example, the end caps 52 and 53 may be made of plastic material which is the same as that of the housing 10 but is treated, such as colored, coated or modified, to be opaque, or the caps 52 and 53 may be made of other suitable materials different from that of the housing 10. Ports (not shown) configured to be respectively connected to the plugs 23 at two ends of the LED circuit board 21 are respectively provided at inner sides of the end caps 52 and 53, and pins 54 configured to be connected to an external power supply are respectively provided at outer sides of the end caps 52 and 53. In the embodiment as shown, the LED driver 30 is arranged at a left end of the LED circuit board 21, thus the left end cap 52 may be slightly different from the right end cap 53. The left end cap 52 is longer in the longitudinal direction, which enables the left end cap 52 inserted into the housing 10 to cover a part of the LED circuit board 21 integrated with the LED driver 30 and not emitting light, i.e., the first section 21*a* of the LED circuit board 21, such that when in use the first section 21*a* cannot be seen from the outside. The external power supply is applied to the LED driver 30 only via the left end cap 52, thus the internally connecting port and the externally connecting pin 54 of the left end cap 52 are arranged to allow the LED plug 23 at this side to be electrically connected to the external power supply. The right end cap 53 may be shorter in the longitudinal direction, as long as the right opening of the housing 10 may be closed by the right end cap 53. The internally connecting port and the externally connecting pin 54 of the right end cap 53 may be common connectors which are configured to fix the lighting device 100 and not to provide the function of electrical connection.

In addition, as shown clearly in FIG. 1, since the first section 21*a* needs to be covered by the end cap 52, considering the thickness of the end cap, the first section 21*a* may be formed to be slightly narrower than the second section 21*b* to form symmetrically stepped portions 24 at the junction between the two sections. In the assembled state, side walls of the end cap may abut against the stepped portions 24 to allow the interior space to be effectively used and to facilitate the positioning of the end cap. If necessary, as shown in FIG. 4, an upper part of the left end cap 52 corresponding to the first section 21*a* may be cut off to further save the space that may be used to arrange the electronic components 31.

Each of the end caps 52 and 53 may further include a locking part 55, and the locking parts 55 may be snap-fitted on the bracket 40, thus locking the end caps 52 and 53 onto the bracket 40.

Figure 5:
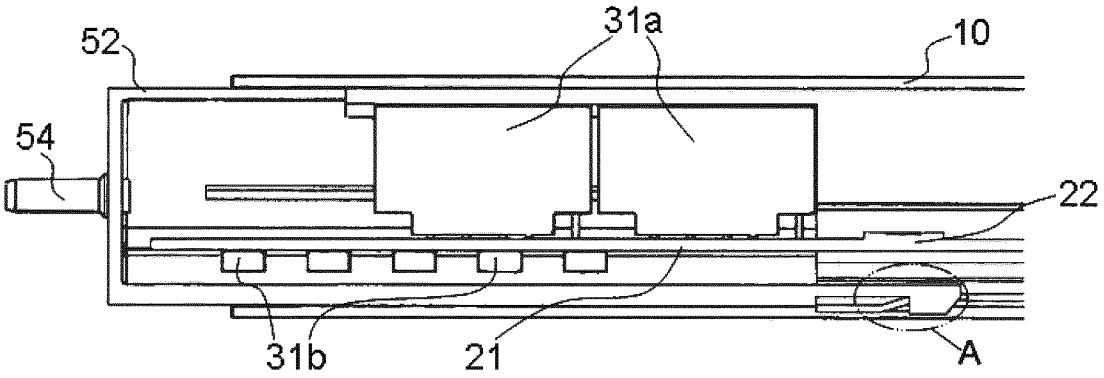
FIG. 5 is a longitudinal sectional view of an end of the LED lighting device according to an embodiment of the present invention, showing the LED driver in an assembled state, and an end cap in a locked state.
Figure 6:
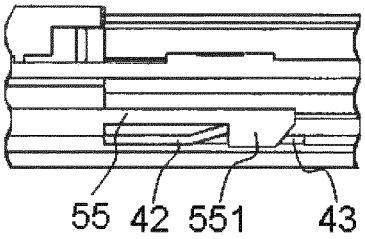
FIG. 6 is an enlarged detail view of part A in FIG. 5.

The above locking structure of the end caps 52 and 53 and the bracket 40 according to an embodiment of the present invention is further described in detail hereinafter with reference to FIGS. 5 and 6. FIG. 5 is a longitudinal sectional view of the left end portion of the LED lighting device 100, and FIG. 6 is an enlarged detail view of part A in FIG. 5 circled by a double-dot-dashed line.

According to the embodiment illustrated, the locking part 55 extends a length horizontally along a longitudinal direction of the end cap 52, 53 from an insertion end of the end cap 52, 53. The locking part 55 is substantially in an L shape, and includes, at its tip end, a locking protrusion 551 protruding downward. The locking part 55 may be integrally molded with the end cap 52, 53.

Correspondingly, as shown in FIGS. 1 and 5, the bottom of the bracket 40 may be formed with a straight section, and the straight section extends along a longitudinal direction of the bracket 40 over the entire length or part of the length of the bracket 40. An elastic tab 42 bending upward obliquely is provided on the straight section of the bracket 40 along the longitudinal direction, and a cutout 43 is formed at a rear side of the elastic tab 42. The shape of the cutout 43 corresponds to the shape of the locking protrusion 551 of the locking part 55, and the size of the cutout 43, especially the size of the cutout in the longitudinal direction is slightly greater than the size of the locking protrusion 551, to allow the locking protrusion 551 to be loose-fitted into the cutout 43 easily. For example, it is possible to form the straight section on the bottom of the metal bracket 40 by pressing firstly, and then perform cutting and bending on the straight section to form the elastic tab 42 and the cutout 43. As shown in FIG. 1, in an assembled state, the straight section of the bracket 40 is spaced apart by a predetermined distance from a lowermost side of the LED light-emitting unit 20 with the LED light-emitting unit 20 being integrated with the LED driver 30 and mounted on the bracket 40, to allow the locking part 55 of the end cap 52, 53 to be inserted between the straight section of the bracket 40 and the lowermost side of the LED light-emitting unit 20. The above locking structure and its manufacturing method are only illustrative, and the present invention is not limited thereto, instead, the end cap may be locked to the bracket by other suitable methods.

With such an arrangement, when inserting the end cap 52, 53 into the housing 10 with the locking part 55 of the end cap 52, 53 being aligned with the elastic tab 42 of the bracket 40, the locking protrusion 551 at the tip end of the locking part 55 depresses the elastic tab 42 bending upward obliquely, and then passes over the elastic tab 42, till the locking protrusion 551 fully falls into the cutout 43 in the process of advancing of the end cap 52, 53, and no longer applies a sufficient urging force downward to the elastic tab 42. As shown more clearly in FIG. 6, at this time, the elastic tab 42 recovers to a state of bending upward obliquely, to abut against a root portion of the locking protrusion 551 to prevent it from retreating, thus locking the end cap 52, 53 in a desired position by the engagement of the locking protrusion 551 with the cutout 43 and the elastic tab 42. In this position, the insertion end of the end cap 52 is substantially aligned with an edge of the first section 21*a* to be covered of the LED circuit board. That is to say, the end cap 52 exactly fully covers the first section 21*a* which is integrated with the LED driver 30 and does not emit light. The locking structure may be unlocked by inserting from outside a special tool, such as a rigid metal sheet or the like, to press downward the elastic tab, thus accidental disassembling or undesirable operating may be prevented.

Figure 7:
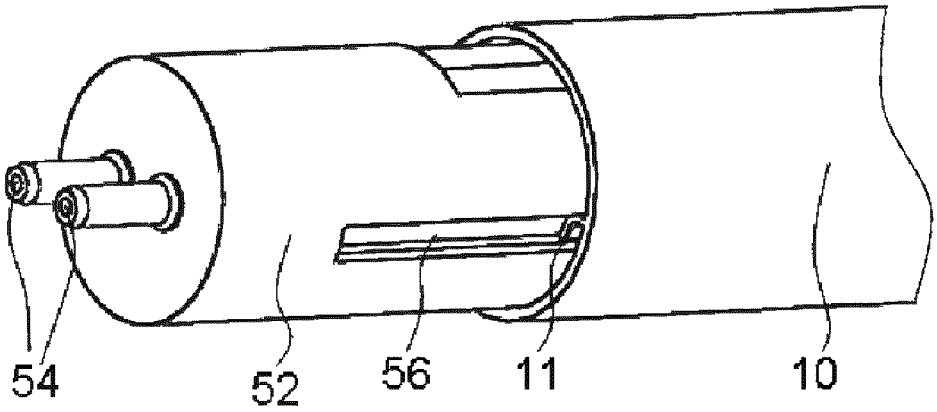
FIG. 7 shows an enlarged detail view of the end cap according to an embodiment of the present invention.

In order to prevent the end cap and the bracket from integrally moving along the longitudinal direction, as shown in FIG. 7, each of the end caps 52 and 53 may be provided at either side with a groove 56. The groove 56 extends a certain length along a longitudinal direction at an insertion end side of the end cap, configured to be fitted with the hook-shaped portion 11 on the inner surface of the housing 10 and allow the hook-shaped portion 11 to slide in the groove 56. The moving distance of the end cap 52, 53 with respect to the housing 10 along the longitudinal direction may be limited by an extending range of the groove 56. In addition, after being assembled, the ports at the inner side of the end cap 52, 53 are engaged with the plugs 23 of the circuit board 21, to limit the displacing of the LED circuit board 21 and in turn the bracket 40 along the longitudinal direction of the lighting device 100. That is, the LED light-emitting unit 20, the LED driver 30 and the bracket 40 accommodated in the LED lighting device 100 are fixed.

Since the housing 10 of the lighting device 100, and the bracket 40, the LED circuit board 21 accommodated in the housing 10 are all in an elongated shape, and made of materials having different thermal expansion coefficients, hence the difference in heat expansion and cold contraction in the longitudinal direction of the plastic housing and those metal components inside the plastic housing is appreciable, thus being apt to cause the tube to get stuck due to dimension discrepancy caused by this difference. In the present invention, with the end cap 52 and 53 being locked to the steel bracket 40 instead of the housing, the bracket 40 and the LED circuit board 21 are allowed to extend or contract freely in the longitudinal direction, and with the arrangement of the grooves 56, the end caps 52, 53 are allowed to displace with respect to the housing 10 in the longitudinal direction appropriately, thus simply and effectively addressing the issue of getting stuck or deformation of the lighting device 100 caused by mismatching of the thermal expansion coefficients of different materials.

The LED lighting device 100 of the present invention having the above configuration is easy to manufacture and assemble, and facilitates modular production. The manufacturing method of the LED lighting device 100 according to an embodiment of the present invention is described hereinafter with reference to FIGS. 8 to 14.

Figure 8:
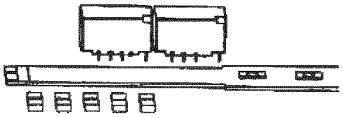
FIGS. 8 to 14 are flow charts schematically showing an assembling method of the LED lighting device according to an embodiment of the present invention.
Figure 9:
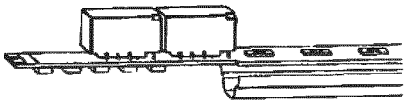
Figure 10:
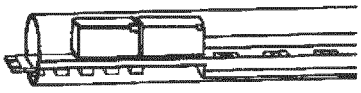
Figure 11:
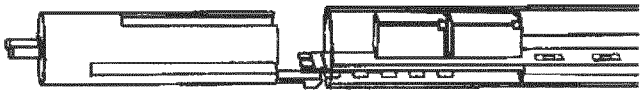
Figure 12:
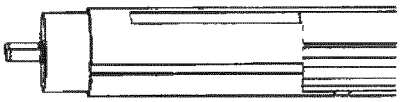
Figure 13:
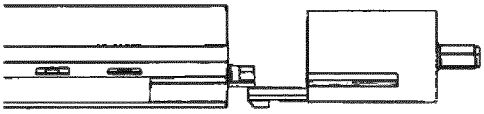
Figure 14:
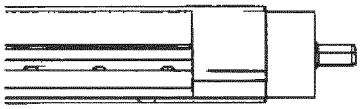

As shown in FIG. 8, firstly, electronic components of an LED driver are soldered on a circuit board mounted with LED elements. Then, as shown in FIG. 9, the LED circuit board is bonded and fixed to a supporting part of a bracket by, for example, adhesive, to allow a first section of the LED circuit board integrated with the LED driver to be suspended outside the bracket. The adhesive is preferably a thermally conductive adhesive, and is uniformly coated between contact surfaces of the bracket and the LED circuit board, thus facilitating heat dissipation. Next, as shown in FIG. 10, the bracket together with the adhesively bonded LED circuit board is inserted into a housing from an opening at one side of the housing, and is accommodated in the housing, to allow only circuit board plugs at tip ends of the LED circuit board to protrude out from the openings at opposite sides of the housing. As shown in FIGS. 11 and 12, a left end cap is inserted into the housing, and is locked to the bracket. Finally, as shown in FIGS. 13 and 14, a right end cap is inserted into the housing and is locked to the bracket, thus finishing the assembling of the lighting device. It may be appreciated that, it is not necessary for the left end cap and the right end cap to be assembled in a specific sequence.

Though it is put forward herein the example of the LED tube in which the LED driver is integrated at one end of the LED circuit board, it may be appreciated by those skilled in the art that the embodiment of the present invention is not limited thereto. Instead, the LED driver may be integrated in any appropriate part(s) of the LED circuit board according to requirements. Hence, the conception of the present invention is also applicable in LED lighting devices in any other shapes and configurations, including the LED tube being applied voltage from two sides.

In addition, though the present invention is illustrated taken the T5 tube as an example, the LED lighting device in the present invention may also be formed in any other shapes, for example, circular, elliptic, and triangular, and various irregular shapes, and in some variations, the LED lighting device may have only one opening in a housing.

While preferred embodiments of the present invention have been described in detail herein, it should be understood that the present invention is not limited to the specific structures described in detail and illustrated herein, and those skilled in the art can also achieve other variants and modifications without departing from the principle and scope of the application, and these variants and modifications should also be deemed to fall into the protective scope of the present invention.

LIST OF REFERENCE NUMERALS SIGNS

LED lighting device 100
housing 10
hook-shaped portion 11
opening 12, 13
LED light-emitting unit 20
circuit board 21
first section 21*a*
second section 21*b*
LED element 22
circuit board plug 23
stepped portion 24
LED driver 30
electronic component 31
first set of electronic components 31*a*
second set of electronic components 31*b*
drive circuit 32
bracket 40
supporting part 41
elastic tab 42
cutout 43
space S1, S2
end cap 52, 53
pin 54
locking part 55
locking protrusion 551
groove 56

What is claimed is:

1. A light-emitting diode (LED) lighting device comprising:
- a housing;
- an LED light-emitting unit arranged inside the housing, wherein the LED light-emitting unit comprises:
  - a circuit board; and
  - LED elements arranged on the circuit board;
- an LED driver at least partially arranged inside the housing and configured to drive the LED light-emitting unit to operate, wherein the LED driver comprises:
  - first electronic components arranged on a first side of the circuit board; and
  - second electronic components arranged on an opposing second side of the circuit board; and
- a bracket arranged inside the housing and supporting the circuit board inside the housing such that the circuit board separates an interior of the housing into a first space and a second space, wherein:
  - the first electronic components are disposed in the first space; and
  - the second electronic components are disposed in the second space.

2. The LED lighting device according to claim 1, wherein the bracket is comprised of steel.

3. The LED lighting device according to claim 1, wherein the bracket has an outer profile fitting against an inner surface of the housing, and wherein the bracket is formed with a supporting part, with the circuit board being disposed and adhesively bonded on the supporting part.

4. The LED lighting device according to claim 3, wherein the supporting part of the bracket is formed by bending a portion of the bracket.

5. The LED lighting device according to claim 3, wherein the supporting part of the bracket is a pair of extension arms extending inward from an inner surface of the bracket.

6. The LED lighting device according to claim 3, wherein a pair of hook-shaped portions are formed on the inner surface of the housing and are configured to cooperate with two side ends of the bracket to position the bracket in the housing.

7. The LED lighting device according to claim 3, wherein a position of the supporting part in a height direction is set to allow the circuit board supported by the supporting part to separate the interior of the housing into the first and second spaces for respectively accommodating the first electronic components and the second electronic components.

8. The LED lighting device according to claim 1, wherein the lighting device is formed into a tubular body, the housing is a T5 tube, and the bracket has a generally arc-shaped cross section.

9. The LED lighting device according to claim 1, further comprising an end cap configured to close an opening of the housing and electrically connect the LED driver and the LED light-emitting unit to an external power supply.

10. The LED lighting device according to claim 9, wherein the end cap comprises a locking part configured to lock the end cap to the bracket.

11. The LED lighting device according to claim 10, wherein:

the locking part extends outward from the end cap and comprises, at a tip end, a locking protrusion protruding downward; and a bottom of the bracket is formed with an elastic tab bending upward obliquely and a cutout located at a rear side of the elastic tab such that the locking protrusion passes over the elastic tab and snap-fits into the cutout.

12. A method for manufacturing the LED lighting device according to claim 1, the method comprising:

soldering the first and second electronic components of the LED driver and the LED elements of the LED light-emitting unit on the same circuit board;

adhesively bonding the soldered circuit board on the bracket;

disposing the adhesively bonded assembly of the circuit board and the bracket into the housing from at least one opening of the housing; and closing the at least one opening of the housing by at least one end cap.

13. The method according to claim 12, wherein closing the at least one opening of the housing by the at least one end cap involves locking a locking part of the at least one end cap to a bottom of the bracket.

14. The method according to claim 12, wherein:

the housing is a T5 tube;

the at least one opening comprises a first opening and a second opening; and the at least one end cap comprises a first end cap and a second end cap which respectively close the first and second openings located at opposite ends of the T5 tube.

15. The LED lighting device according to claim 1, wherein the LED elements are arranged on the first side of the circuit board and disposed in the first space.

16. The LED lighting device according to claim 1, further comprising an end cap configured to close an end opening of the housing and electrically connect the LED driver and the LED light-emitting unit to an external power supply.

17. The LED lighting device according to claim 16, wherein the end cap is configured to be inserted in the housing.

18. The LED lighting device according to claim 16, wherein the end cap is configured to be engaged in a locking manner with the bracket.

19. The LED lighting device according to claim 1, wherein the first electronic components are of greater height dimension than the second electronic components.

20. A light-emitting diode (LED) lighting device comprising:

a housing;

an LED light-emitting unit arranged inside the housing; and an LED driver configured to drive the LED light-emitting unit to operate;

wherein the LED driver and the LED light-emitting unit are integrally arranged inside the housing;

wherein the LED lighting device further comprises a bracket made of steel and configured to support the LED driver and the LED light-emitting unit inside the housing, wherein the bracket has an outer profile fitting against an inner surface of the housing, and is formed with a supporting part, with the circuit board being disposed and adhesively bonded on the supporting part;

wherein LED elements of the LED light-emitting unit are arranged on one side of the circuit board, and one part of electronic components of the LED driver are arranged on the one side of the circuit board, and the other part of electronic components of the LED driver are arranged on the other side of the circuit board; and wherein the one part of electronic components are higher than the other part of the electronic components in height, the position of the supporting part in a height direction is set to allow the circuit board supported by the supporting part to separate an interior of the housing into two spaces, for respectively accommodating the one part of electronic components and the other part of electronic components.

21. A light-emitting diode (LED) lighting device comprising:

a housing;

an LED light-emitting unit arranged inside the housing; and an LED driver configured to drive the LED light-emitting unit to operate;

wherein the LED driver and the LED light-emitting unit are integrally arranged inside the housing;

wherein the LED lighting device further comprises a bracket made of steel and configured to support the LED driver and the LED light-emitting unit inside the housing, wherein the bracket has an outer profile fitting against an inner surface of the housing, and is formed with a supporting part, with the circuit board being disposed and adhesively bonded on the supporting part;

wherein the LED lighting device further comprises an end cap configured to close an opening of the housing and configured to electrically connect the LED driver and the LED light-emitting unit to an external power supply, wherein the end cap comprises a locking part, through which the end cap can be locked to the bracket, wherein the locking part extends outward from the end cap, and comprises, at a tip end, a locking protrusion protruding downward, the bottom of the bracket is formed with an elastic tab bending upward obliquely and a cutout located at a rear side of the elastic tab, and the locking protrusion passes over the elastic tab and snap-fits into the cutout.

* * * * *